US010426253B2

(12) United States Patent
Baumann et al.

(10) Patent No.: US 10,426,253 B2
(45) Date of Patent: Oct. 1, 2019

(54) CLEANING DEVICE AND ASSOCIATED OPERATING METHOD

(71) Applicant: Dürr Systems AG, Bietigheim-Bissingen (DE)

(72) Inventors: Michael Baumann, Flein (DE); Sonja Brauchle, Eberhardzell (DE); Thomas Buck, Sachsenheim (DE); Frank Herre, Oberriexingen (DE); Georg M. Sommer, Ludwigsburg (DE); Sandra Schlichenmaier, Aspach (DE); Andreas Fischer, Ludwigsburg (DE); Peter Marquardt, Steinheim-Kleinbottwar (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 152 days.

(21) Appl. No.: 15/309,267

(22) PCT Filed: May 4, 2015

(86) PCT No.: PCT/EP2015/000907
§ 371 (c)(1),
(2) Date: Nov. 7, 2016

(87) PCT Pub. No.: WO2015/169432
PCT Pub. Date: Nov. 12, 2015

(65) Prior Publication Data

US 2017/0072421 A1 Mar. 16, 2017

(30) Foreign Application Priority Data

May 7, 2014 (DE) ..... 10 2014 006 647

(51) Int. Cl.
*B08B 7/04* (2006.01)
*A47K 7/04* (2006.01)
(Continued)

(52) U.S. Cl.
CPC ..... *A46B 13/001* (2013.01); *A46B 17/06* (2013.01); *B05B 3/02* (2013.01); *B05B 7/066* (2013.01);
(Continued)

(58) Field of Classification Search
CPC ..... B05B 3/02; B05B 7/066; B05B 13/0421; B05B 15/555; B05B 15/14; B05B 15/52;
(Continued)

(56) References Cited

U.S. PATENT DOCUMENTS 4,191,590 A * 3/1980 Sundheim ..... A47L 11/34 134/102.1
4,830,882 A * 5/1989 Ichinose ..... B05B 15/557 427/424
(Continued)

FOREIGN PATENT DOCUMENTS

CN 103619490 A 3/2014
DE 19508725 A1 9/1995
(Continued)

OTHER PUBLICATIONS

International Search Report and Written Opinion for PCT/EP2015/000907 dated Sep. 21, 2015 (10 pages; with English translation).
(Continued)

*Primary Examiner* — Alexander Markoff
(74) *Attorney, Agent, or Firm* — Bejin Bieneman PLC

(57) ABSTRACT

A cleaning device for cleaning an atomizer, in particular a rotary atomizer, is provided. The cleaning device includes a wet cleaning station having at least one cleaning nozzle for the wet cleaning of the atomizer with a cleaning fluid. The atomizer is introduced into the wet cleaning station in an introduction direction. The cleaning nozzle has a rotatable cleaning trunk for dispensing the cleaning fluid. The cleaning device, in some embodiments, also includes a dry
(Continued)

Figure 1:
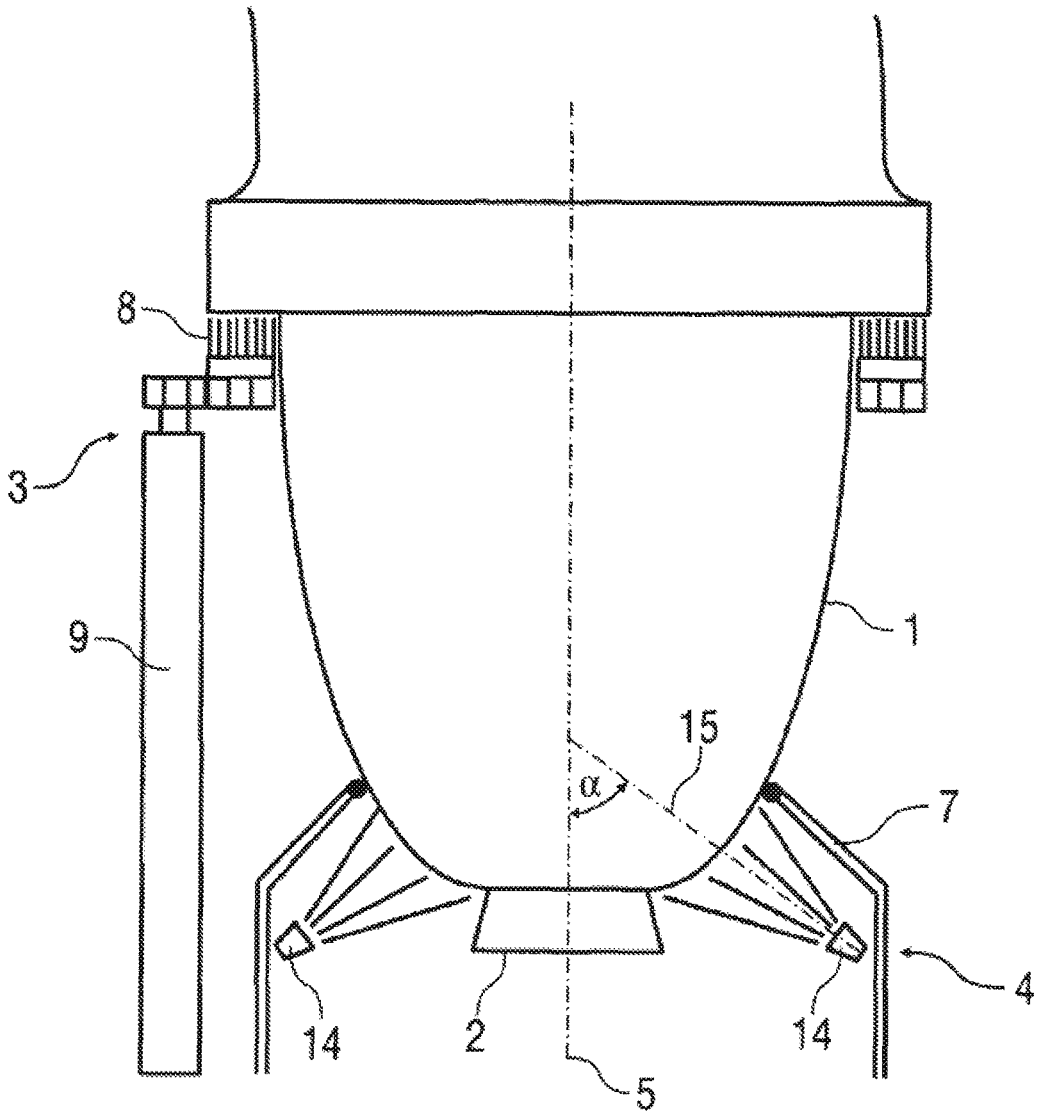

cleaning station. A corresponding operating method is also provided.

20 Claims, 6 Drawing Sheets

(51) Int. Cl.

| | |
|---|---|
| ***A46B 13/00*** | (2006.01) |
| ***B05B 3/02*** | (2006.01) |
| ***B05B 7/06*** | (2006.01) |
| ***A46B 17/06*** | (2006.01) |
| ***B08B 1/00*** | (2006.01) |
| ***B08B 1/04*** | (2006.01) |
| ***B08B 3/02*** | (2006.01) |
| ***B05B 15/555*** | (2018.01) |
| ***B05B 15/14*** | (2018.01) |
| ***B05B 15/52*** | (2018.01) |
| *B05B 13/04* | (2006.01) |

(52) U.S. Cl.
CPC ..... *B05B 15/14* (2018.02); *B05B 15/52* (2018.02); *B05B 15/555* (2018.02); *B08B 1/002* (2013.01); *B08B 1/04* (2013.01); *B08B 3/02* (2013.01); *B05B 13/0421* (2013.01)

(58) Field of Classification Search
CPC .. B08B 3/02; B08B 1/002; B08B 1/04; A46B 13/001; A46B 17/06
See application file for complete search history.

(56) References Cited

U.S. PATENT DOCUMENTS

| | | | | |
|---|---|---|---|---|
| 5,589,225 | A | 12/1996 | Yamada et al. | |
| 8,056,830 | B1 * | 11/2011 | Pedersen | B05B 3/06 239/222.13 |
| 2003/0029933 | A1 | 2/2003 | Hasegawa | |
| 2003/0127046 | A1 * | 7/2003 | Zehner | B08B 1/04 118/302 |
| 2006/0065760 | A1 * | 3/2006 | Micheli | B05B 3/1014 239/237 |
| 2008/0029128 | A1 * | 2/2008 | Beijbom | B05B 15/555 134/22.1 |
| 2008/0072927 | A1 * | 3/2008 | Weiss | B08B 3/02 134/10 |
| 2009/0057443 | A1 * | 3/2009 | Sendo | B05B 3/022 239/405 |
| 2010/0126541 | A1 * | 5/2010 | Schmon | B05B 7/2478 134/198 |
| 2010/0320289 | A1 * | 12/2010 | Kuo | B05B 3/022 239/290 |
| 2012/0286065 | A1 * | 11/2012 | Lin | B05B 3/0409 239/225.1 |
| 2014/0008457 | A1 | 1/2014 | Bosua | |
| 2014/0075695 | A1 | 3/2014 | Kleiner et al. | |
| 2014/0124009 | A1 | 5/2014 | Jensen | |

FOREIGN PATENT DOCUMENTS

| | | | | |
|---|---|---|---|---|
| DE | 10049633 | A1 * | 4/2002 | B08B 3/02 |
| DE | 69618815 | T2 | 10/2002 | |
| DE | 10129667 | A1 | 1/2003 | |
| DE | 10 2006 039 641 | A1 | 2/2008 | |
| DE | 102007033036 | A1 | 1/2009 | |
| DE | 10 2010 052 698 | A1 | 5/2012 | |
| DE | 202012103426 | U1 | 9/2012 | |
| EP | 0869848 | B1 | 1/2002 | |
| EP | 1287902 | A1 * | 3/2003 | B05B 9/04 |
| EP | 1367302 | A2 | 12/2003 | |
| EP | 1671706 | A2 | 6/2006 | |
| EP | 2522435 | A1 | 11/2012 | |
| GB | 2198033 | A | 6/1988 | |
| JP | 2003-154294 | A | 5/2003 | |
| JP | 2009-061354 | A | 3/2009 | |
| JP | 2013-071077 | A | 4/2013 | |
| WO | 97/18903 | A1 | 5/1997 | |
| WO | 2010028864 | A2 | 3/2010 | |

OTHER PUBLICATIONS

Chinese Office Action Search Report for CN Patent Application No. 201580023833.2 dated Jun. 7, 2018 (with English translation; 8 pages).
Notification of Reasons for Rejection from the Japan Patent Office for JP Application No. 2016-566947 dated May 21, 2019 (15 pages; with English translation).

* cited by examiner

Section A-A

CLEANING DEVICE AND ASSOCIATED OPERATING METHOD

CROSS-REFERENCE TO RELATED APPLICATIONS

This application is a national stage of, and claims priority to, Patent Cooperation Treaty Application No. PCT/EP2015/000907, filed on May 4, 2015, which claims priority to German Application No. DE 10 2014 006 647.9 filed on May 7, 2014, each of which applications are hereby incorporated herein by reference in their entireties.

BACKGROUND

This disclosure relates to a cleaning device for cleaning an atomizer, in particular a rotary atomizer. The disclosure further relates to a method for operating a cleaning device of this type.

Rotary atomizers may be used for painting vehicle body parts. With such usage, rotary atomizers need to be cleaned from time to time, because, e.g., deposits of surplus paint spray (overspray) can build up on the outside of the atomizer. Cleaning devices such as those known from DE 10 2010 052 698 A1, EP 1 671 706 A2, WO 97/18903 A1 and DE 10 2006 039 641 A1 may be used for this purpose. These known cleaning devices typically comprise a housing, into which the atomizer is introduced for cleaning, the atomizer then being sprayed with cleaning agent from cleaning nozzles inside the housing, wherein said cleaning agent can be a mixture of compressed air and cleaning fluid. EP 1 367 302 A2, DE 101 29 667 A1, GB 2 198 033 A, DE 10 2007 033 036 A1, US 2014/0008 457 A1, DE 195 08 725 A1 are also disclosures related to such prior systems.

Additionally, mobile cleaning devices comprising a rotatable cleaning trunk for dispensing a cleaning fluid are known from DE 20 2012 103 426 U1. However, these are mobile, portable cleaning devices, which are used for cleaning surfaces, as opposed to atomizers.

A disadvantage of the known cleaning devices for rotary atomizers is a relatively long cleaning time, which is not consistent with the transfer time of a painting facility, i.e. the time required during a change of the vehicle body to be painted, to convey the vehicle body that has already been painted out of the paint booth and to introduce the new, as yet unpainted, vehicle body into the paint booth. For example, in some painting facilities, such a changeover time of a vehicle body is 15 seconds. As, during the changeover time the atomizer is not in use, thus the atomizer is available for cleaning without holding up operations. It is therefore desirable to create a cleaning device that requires a shorter cleaning time, which is ideally shorter than the changeover time between consecutive vehicle bodies.

SUMMARY

The present disclosure provides a wet cleaning station for a rotary atomizer used in, e.g., vehicle component painting applications, the station having at least one cleaning nozzle for spraying the atomizer with a cleaning fluid, the atomizer being introduced into the wet cleaning station for cleaning purposes.

In contrast to the prior art, the cleaning nozzle of the cleaning device according to the principles of the present disclosure is not immovable but has an elongated, rotatable cleaning trunk, which rotates in operation and has a nozzle aperture at its free end, through which the cleaning fluid is dispensed.

In some embodiments, at its upstream end, the cleaning trunk runs substantially coaxially to its rotational axis. Conversely, the free end of the cleaning trunk is, in some embodiments, slightly bent relative to the rotational axis of the cleaning trunk, so that the cleaning fluid can be sprayed out in different directions as a function of the rotational position of the cleaning trunk. Accordingly, the cleaning fluid may impact the surface of the component to be cleaned—e.g. a rotary atomizer—in a circular path. The rotary motion of the cleaning trunk and the associated changes in direction of the cleaning fluid may, thereby, provide an improved cleaning action, which in turn allows the cleaning time to be shortened. For example, with the cleaning device according to the present disclosure, the cleaning time can be less than 30 seconds, 20 seconds, 15 seconds or even 10 seconds, without detracting from the quality of cleaning.

In some embodiments, the cleaning trunk according to the principles of the present disclosure includes a mass distribution and/or an external contour member that is rotationally symmetrical to the rotational axis of the cleaning trunk, in order to inhibit the vibration resultant from rotation of the cleaning trunk.

In other embodiments of the present disclosure, trim weights are attached to the cleaning trunk, the mass and attachment point of the trim weights being selected so that the cleaning trunk is statically and/or dynamically balanced.

In some embodiments, a cleaning device according to the principles of the present disclosure also comprises a speed controller to control the rotational speed of the cleaning trunk. For example, the speed controller can be a centrifugal governor, which dissipates a part of the drive air intended for driving a turbine wheel. In such embodiments, the cleaning trunk is therefore pneumatically driven by a turbine wheel, the turbine wheel being supplied by driving air, and the centrifugal governor then channels off a part of the cleaning air fed in on the inlet side as a function of the rotational speed of the cleaning trunk, so that the separated portion of cleaning air no longer serves to drive the turbine wheel, which results in a corresponding reduction in the drive torque of the turbine wheel and hence results in a limitation of the speed. According to the principles of the present disclosure, such a centrifugal governor can also be implemented with a jet propulsion of the cleaning trunk, as described in detail below.

In some embodiments of the present disclosure, a part of the driving air can be channeled off, for example, with a collar that fits closely on the outside of a driveshaft, through which the driving air flows and, with increasing rotational speed, uncovers radial holes in the wall of the driveshaft, thereby dissipating part of the driving air so that it is no longer available for driving purposes. In such an example, the collar is therefore rotationally connected with the driveshaft. At low speeds of the cleaning trunk, the collar rests tight against the radial holes in the wall of the driveshaft, sealing them up so that no driving air escapes via the radial holes. However, as the rotational speed of the cleaning trunk increases, the collar lifts off from the wall of the driveshaft under the effect of centrifugal force, thereby opening the radial holes in the wall of the driveshaft so that a part of the driving air can escape out through the radial holes and is therefore no longer available for driving purposes.

The collar of such a centrifugal governor can consist of a plurality of segments, for example, which are pressed from outside onto the circumferential surface of the driveshaft by an elastic O-ring. Thus the elastic O-ring presses the segments radially inwards onto the outer wall of the driveshaft against centrifugal force, thereby sealing off the radial holes in the outer wall of the driveshaft.

In other embodiments of the present disclosure, a centrifugal governor includes a brake element, which deforms as a function of rotational speed, thereby generating a braking torque. As the rotational speed increases, the brake element deforms in such a manner that the brake element contacts a fixed braking surface, thereby generating a braking torque.

In yet other embodiments of the present disclosure, a centrifugal governor is provided along with a jet propulsion of the cleaning trunk. For example, a fluid is emitted via a pipe extending in the circumferential direction of the cleaning trunk and, as a result of its thrust action, said fluid generates a corresponding drive torque. The pipe can be elastic and deforms as a function of the rotational speed of the cleaning trunk and the resulting centrifugal force, so that the discharge direction is speed-dependent. At low rotational speed, the discharge pipe is hardly deformed and dispenses the fluid exactly in the circumferential direction, thereby achieving a maximum thrust and a maximum drive torque. However, with increasing speed and correspondingly higher centrifugal force, such a discharge pipe deforms in such a manner that the discharge direction runs increasingly in the radial direction, whereby the thrust action diminishes and only a slight drive torque continues to be generated, which leads to a corresponding speed limitation.

In some exemplary embodiments of the disclosure, the cleaning nozzle has structural similarities with a known cleaning nozzle, such as is described in EP 2 522 435 A1.

As such, in such embodiments, the cleaning nozzle has a static funnel that encompasses the rotating cleaning trunk. A "funnel" used in the context of the disclosure relates to a housing that is open at the front and widens out towards its front face, e.g. in a conical or convex shape. However, it should be understood that the term "funnel" used in the present disclosure is to be understood to broadly refer to housings with opposing open ends and an at least partially arcuate cross section, e.g. "funnel" may also includes a cylindrical external housing of the cleaning nozzle.

In some exemplary embodiments of the present disclosure, the rotating cleaning trunk is formed of a rigid material, so that deformation of the rotating cleaning trunk is substantially inhibited in operation. In such embodiments, therefore, the cleaning trunk may avoid striking against the internal wall of the funnel, regardless of the rotational speed and the resulting centrifugal force.

In some exemplary embodiments of the present disclosure, the rotatable cleaning trunk widens out towards its free end, especially, e.g. in a conical shape. For example, the cleaning trunk can widen out conically towards its free end with a cone angle of 5°-20° or 10°-15°. Such conical widening provides for rotationally symmetrical mass distribution, despite asymmetrical dispensing of the cleaning fluid.

The cleaning trunk of the present disclosure, in some embodiments, also includes a longitudinal bore, in which an outer hose and an inner hose run coaxially.

In some exemplary embodiments, the inner hose serves to conduct a cleaning fluid, while the annular gap between the outer hose and the inner hose serves to transport compressed air. In such embodiments, the inner hose is therefore connected to a cleaning agent feed line upstream and to a nozzle aperture (outlet aperture) downstream at the free end of the cleaning trunk. Conversely, the annular gap between the outer hose and the inner hose is connected to an air supply line upstream and a nozzle aperture (outlet aperture) downstream at the free end of the cleaning trunk. In the such exemplary embodiments of the disclosure, a mixture of the cleaning fluid and the compressed air is therefore dispensed at the free end of the cleaning trunk, to provide a cleaning action.

In some embodiments, the inner hose is fixed at its upstream end so that it cannot rotate, while the outer hose rotates along with the rotating cleaning trunk, thereby producing a relative movement between inner hose and outer hose. In such embodiments, the outer hose is configured to be stiffer than the inner hose.

According to the principles of the present disclosure, the nozzle aperture of the cleaning trunk is inclined at a particular angle to the rotational axis of the cleaning trunk, so that the rotation of the cleaning trunk results in a constantly changing emission angle. The inclination relative to the rotational axis of the cleaning trunk is, in some embodiments, in the range of, e.g., 2°-30°, 4°-20° or 5°-10°.

Relative movement between the inner hose and the outer hose may result, in some embodiments, in associated wearing of the inner hose and the outer hose, requiring occasional replacement of either or both of the hoses.

The cleaning nozzle according to the disclosure therefore, in some embodiments, comprises a replaceable hose assembly, comprising the inner hose (and possibly also the outer hose) and a clamping element, wherein the clamping element clamps the inner hose and is secured in the cleaning nozzle with a screw connection. In such embodiments, it may be possible to replace the hose assembly quickly and easily, thereby greatly simplifying maintenance of the cleaning device according to the disclosure.

Furthermore, in some embodiments, the cleaning device according to the disclosure comprises a plurality of cleaning nozzles, which are distributed around the circumference of the cleaning device relative to a direction along the introduction axis for the atomizer and may be arranged at equal distances from each other. For example, three cleaning nozzles can be distributed around the circumference of the cleaning device at an angular distance of 120° to each other. However, it should be understood that, according to the principles of the present disclosure, the number of cleaning nozzles, is not restricted to three cleaning nozzles. In another non-limiting example, four cleaning nozzles can also be arranged around the circumference of the cleaning device at an angular distance of 90°.

In some exemplary embodiments of the disclosure, the cleaning nozzles are arranged in a common plane orthogonal to the introduction axis. However, alternatively, in other embodiments, the cleaning nozzles are arranged in several planes, arranged axially one behind the other. For example, three cleaning nozzles can be arranged in each of two parallel planes. When arranging the cleaning nozzles in several planes, it is advantageous if the cleaning nozzles in the individual planes are circumferentially offset relative to the adjacent plane. Such an offset arrangement may result in uniform spraying of the outer surface of the atomizer to be cleaned. For example, the cleaning nozzles in one plane can be arranged centrally between the cleaning nozzles of the adjacent plane. For example, three cleaning nozzles can be arranged at 0°, 120° and 240° in a first plane, while three cleaning nozzles are arranged at 60°, 180° and 300° in a second plane.

Additionally, in some exemplary embodiments of the disclosure, the introduction aperture of the housing is sealed with a seal (e.g. sealing ring, O-ring). Alternatively, in other embodiments, the introduction aperture is sealed with an air seal, wherein the air seal blows sealing air over the introduction aperture. An air seal of this type is known and described, for example, in EP 1 367 302 A2.

Moreover, in some embodiments, an inner tube oriented coaxially to the introduction direction is arranged in the housing of the wet cleaning station spaced below the introduction aperture. This inner tube serves to receive a bell cup of the atomizer to be cleaned for internal rinsing of the bell cup. Detergent is led through the atomizer onto the bell cup and then collected by the inner tube together with any residual dirt.

In some exemplary embodiments of the disclosure, the individual cleaning nozzles are inclined with their emission direction at a particular angle to the introduction direction of the atomizer. Such inclination may be in the range of 20°-80°, and, in some embodiments, may be a value of 60°. On the other hand, in exemplary embodiments, the inclination of the individual cleaning nozzles relative to the surface of the atomizer to be cleaned is 90°.

The angle of inclination of the individual cleaning nozzles may be changed use of a different nozzle mount.

In some embodiments, the angle of inclination of the cleaning nozzles in different planes of cleaning nozzles can vary in order to optimize the cleaning effect.

According to the principles of the present disclosure, there is a certain cleaning distance defined between the outlet aperture of the cleaning nozzles and the surface of the atomizer to be cleaned. The cleaning device according to some embodiments of the disclosure is constructed in such a way that the cleaning distance is in the range of 10 mm-50 mm, and, in some such embodiments, is at a value of 30 mm.

In some exemplary embodiments, the cleaning nozzles according to the disclosure are attached in the wet cleaning station and more precisely in the housing of the wet cleaning station with a nozzle mount, the nozzle mount, in some such embodiments, allowing replaceable attachment of individual cleaning nozzles. Such an exemplary nozzle mount may be vibration-damping in order to decrease the transfer of vibrations from the cleaning nozzles to, ultimately, the housing of the wet cleaning station. For example, a vibration-damping elastomeric component can be provided in the nozzle mount for this purpose, e.g. in the form of an O-ring.

In some exemplary embodiments the nozzle mount clamps the cleaning nozzle in a form fit, said nozzle mount having at least one screw to clamp the cleaning nozzle. In some embodiments, this screw is captive (self-locking) to prevent the screw connection from loosening, despite the vibrations emanating from the cleaning nozzle. The nozzle mount may therefore allow rapid changing of the cleaning nozzle through the two captive screws.

In some embodiments of the present disclosure in which the rotational drive for the rotating cleaning trunk is provided by at least one pneumatically driven rotatable turbine wheel, the turbine wheel has a radial flow from the inside to the outside. It should be understood that other turbine wheel designs are also in accordance with the principles of the present disclosure.

In some exemplary embodiments of the disclosure, the turbine wheel includes a plurality of apertures on the inside thereof to receive the driving air fed into the turbine wheel from inside. In each case, the apertures in the turbine wheel each respectively open into a turbine chamber in the turbine wheel, the individual turbine chambers each having a circumferentially oriented outlet aperture, resulting in a corresponding drive torque. The cross-sectional area of the outlet openings of the individual turbine chambers is, in some embodiments, in the range of 0.5 $mm^2$-3 $mm^2$.

In some exemplary embodiments of the disclosure, after the driving air has flowed through the turbine wheel, the driving air is discharged through sealing air nozzles into the annular gap between the static funnel and the rotating cleaning trunk. This sealing air forms an annular protective sheath for, e.g., inner roller bearings, thereby inhibiting overspray or any other dirt from entering the roller bearings.

According to the principles of the present disclosure, a plurality of turbine wheels, arranged axially behind each other, may be provided to drive the rotating cleaning trunk. Such a configuration may provide relatively increased drive power, for example.

In other embodiments, the cleaning trunk includes a circumferentially oriented outlet aperture at its free end to drive the cleaning trunk with the thrust from the emerging cleaning fluid.

In embodiments of the present disclosure, said cleaning trunk can comprise at least one vane to limit the rotational speed of the cleaning trunk via the flow resistance of said vane. Alternatively or additionally, the vane can also be used for driving, if it has a corresponding air supply.

In some exemplary embodiments, the cleaning device according to the disclosure comprises a cleaning agent connection and a supply air connection, in which compressed air is fed via the supply air connection and cleaning fluid (e.g. solvent) is fed via the cleaning agent connection. In the individual cleaning nozzles the supply air then splits into driving air for driving a turbine wheel in the cleaning nozzle and cleaning air for cleaning the atomizer. The driving air drives the turbine wheel and then serves as sealing air, as already described above. On the other hand, the cleaning air is used exclusively for cleaning the atomizer and is dispensed together with the cleaning fluid onto the atomizer to be cleaned. The ratio of cleaning air to driving air can be 1:1, 2:1, 3:1 or 4:1, for example.

In some embodiments of the present disclosure, the volume flow (or mass flow) of the cleaning fluid and the volume flow (or mass flow) of the supply air are adjustable independently of each other. Such a configuration enables maintenance of the drive torque for the cleaning trunk and the energy of the cleaning air, while reducing the quantity of cleaning fluid. In exemplary embodiments, the quantity of cleaning fluid is set centrally and uniformly for all cleaning nozzles of the cleaning device, e.g. with a pressure control valve, a throttle with interchangeable apertures, or a needle valve, for example. Alternatively or additionally, the cycle time (cleaning time) may be varied (e.g. increased or reduced).

In some exemplary embodiments, the cleaning trunk rotates at a speed in the range from 500 rotations/minute to 30,000 rotations/minute, and, in some such embodiments, a rotation speed is in the particular range from 2,000 rotations/minute to 8,000 rotations/minute.

It should be understood that various components of the cleaning device can be produced using a generative manufacturing process (rapid prototyping). Rapid prototyping processes of this type are known from WO 2010/028864 A2, for example.

In some embodiments of the disclosure, the cleaning device is installed in a fixed location in a coating plant, for example on a grid on the floor of a paint booth.

In other embodiments of the of the disclosure, the cleaning device is installed so that it is movable, for example on a travelling painting robot. The advantage of mounting the cleaning device movably is that the cleaning device may be always in immediate proximity to, e.g., the painting robot, irrespective of the latter's position, so that the cleaning process can commence without needing to move the painting robot, thereby reducing the cleaning time.

In addition to the wet cleaning station described above, the cleaning device according to the disclosure can also have a dry cleaning station for dry or semi-dry cleaning of the atomizer. For example, the dry cleaning station can comprise at least one cleaning brush to brush down the outside of the atomizer. In an exemplary embodiment of the disclosure, the cleaning brush is annular and encircles the atomizer during cleaning.

In some such embodiments, the dry cleaning station is arranged outside the housing of the wet cleaning station. For example, the wet cleaning station is arranged along the introduction axis direction, in some embodiments, downstream of the dry cleaning station, so that the wet cleaning station cleans a front section of the atomizer while the dry cleaning station cleans a rear section of the atomizer.

According to the principles of the present disclosure, the cleaning motion of the cleaning brush relative to the atomizer may differ. In some embodiments of the disclosure, the cleaning brush is installed in a fixed location, the atomizer is rotated around its longitudinal axis during the cleaning process to produce the relative movement between the cleaning brush and the atomizer. In other embodiments of the disclosure, the atomizer is held still during the cleaning process, while the cleaning brush rotates around the atomizer. In yet other embodiments of the disclosure, both the cleaning brush and the atomizer move during the cleaning process to produce the relative movement between cleaning brush and atomizer.

According to the principles of the present disclosure, it is also possible to include a droplet separator underneath the wet cleaning station to capture the atomized cleaning fluid.

A catch device may also be arranged underneath this droplet separator to collect the cleaning fluid separated off by the droplet separator and paint that has been cleaned off.

In addition to the preceding description of the cleaning device according to the disclosure, the disclosure also relates to a corresponding operating method, the method being in accordance with the above description.

However, a particular feature of some embodiments of the operating method according to the disclosure is that, when the atomizer is removed from the cleaning device after the cleaning process, it blasts the cleaning brush with its shaping air to remove any paint dust adhering to the cleaning brush. For example, the atomizer can perform a tumbling motion with the shaping air switched on.

DRAWINGS

Figure 2:
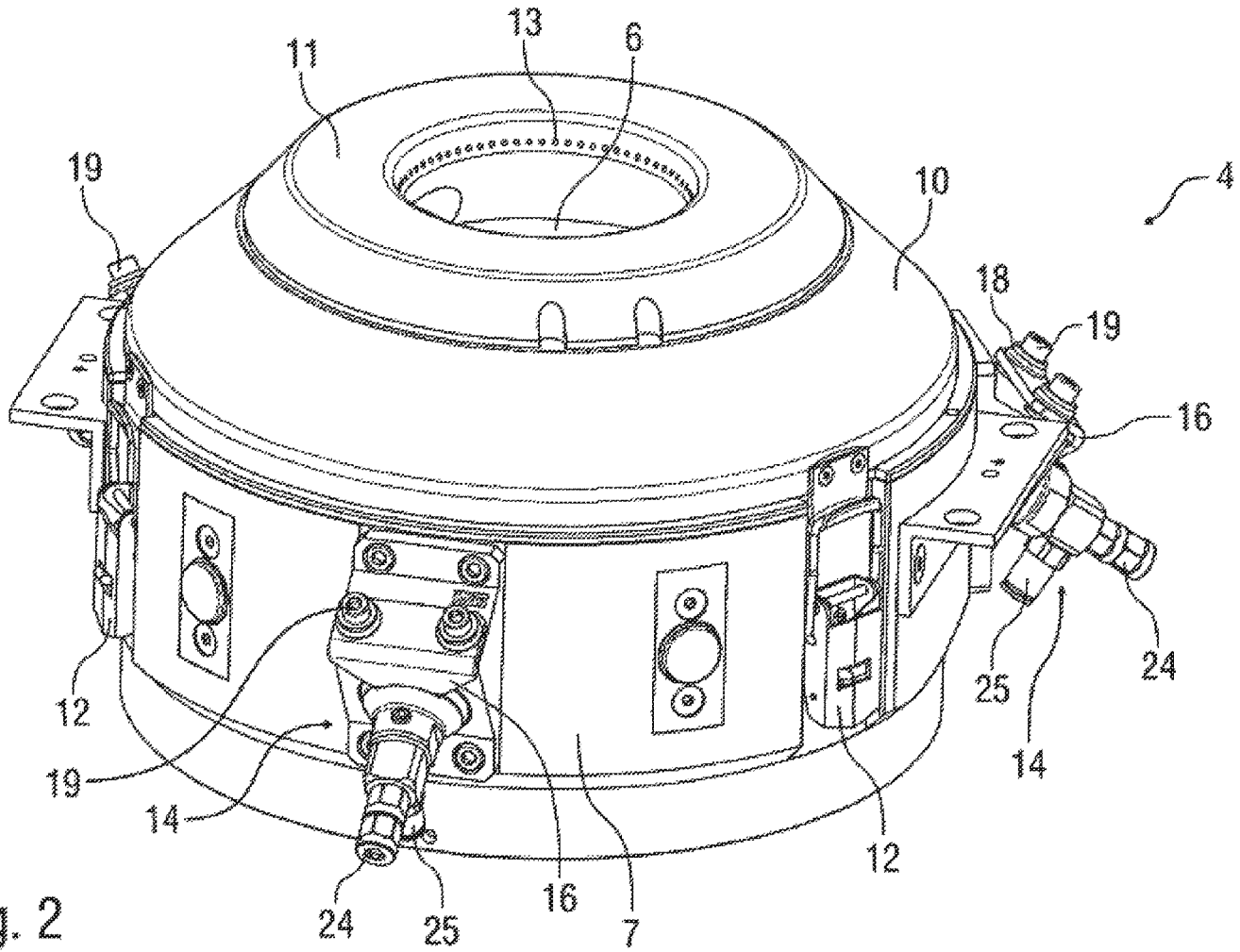
Figure 3:
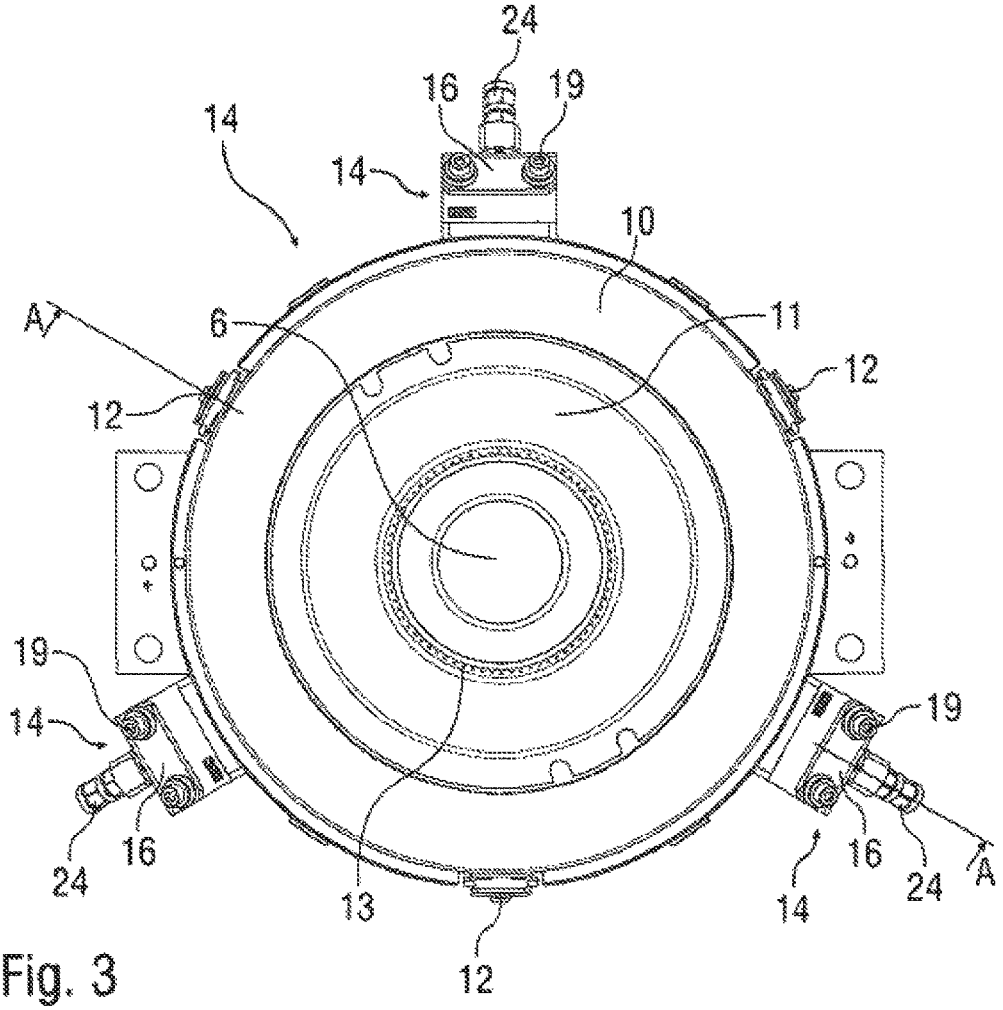
Figure 4:
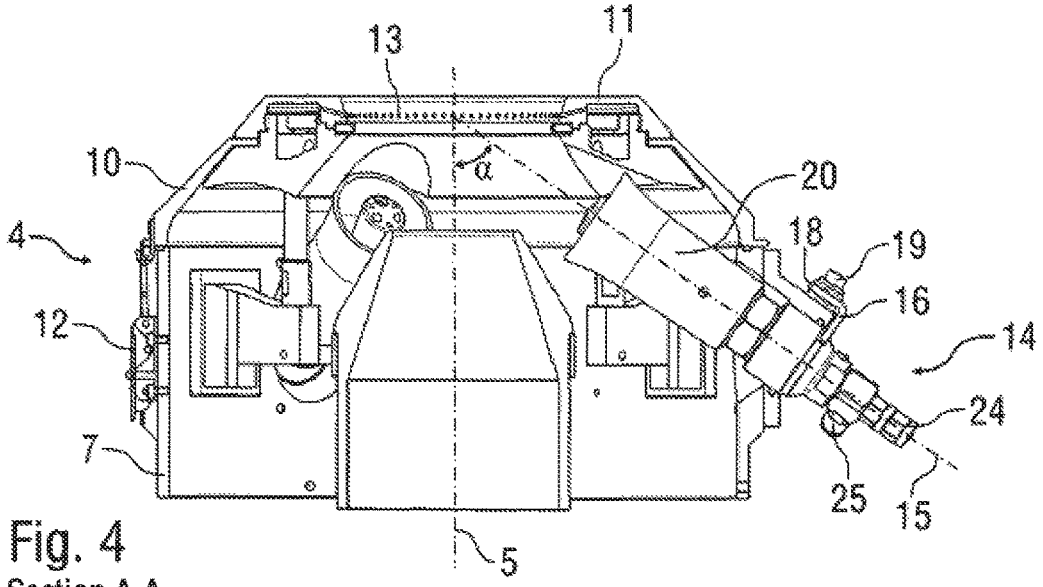
Figure 5:
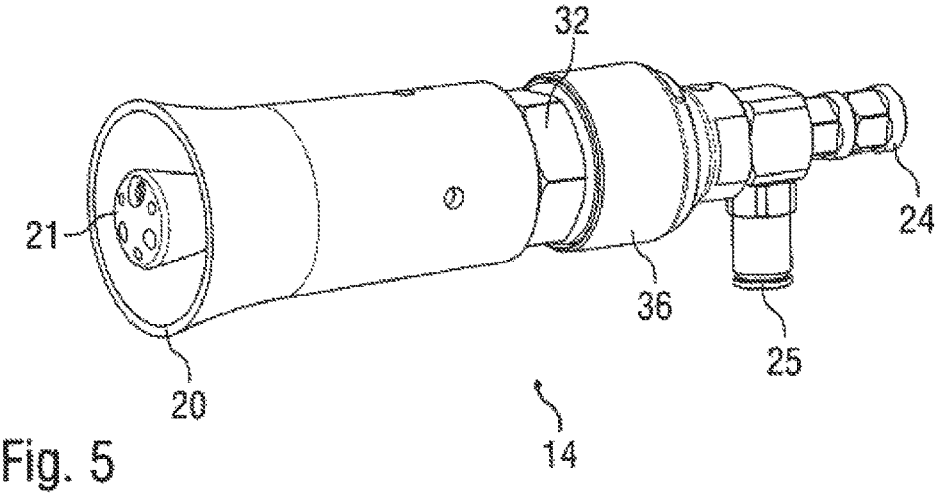
Figure 6:
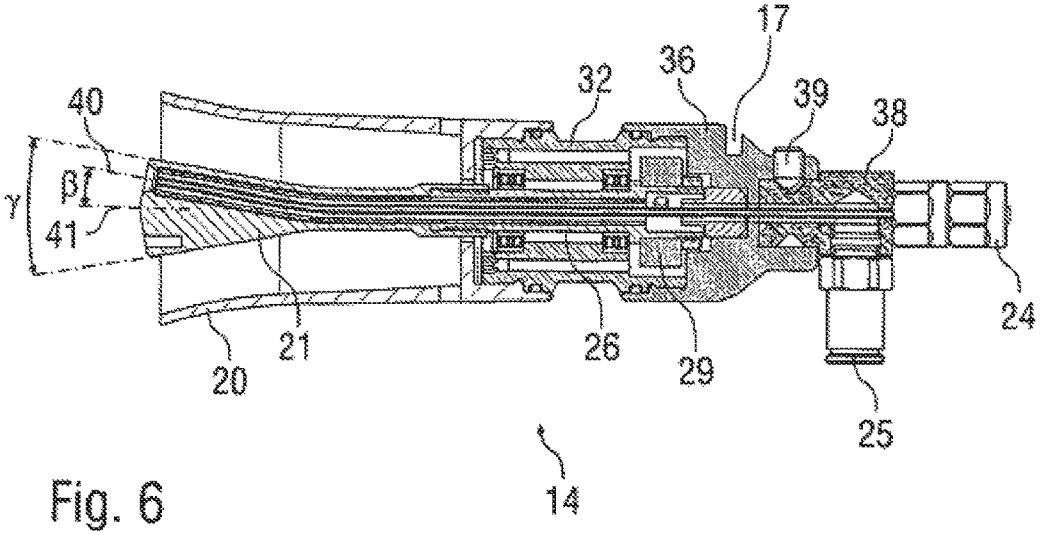
Figure 7:
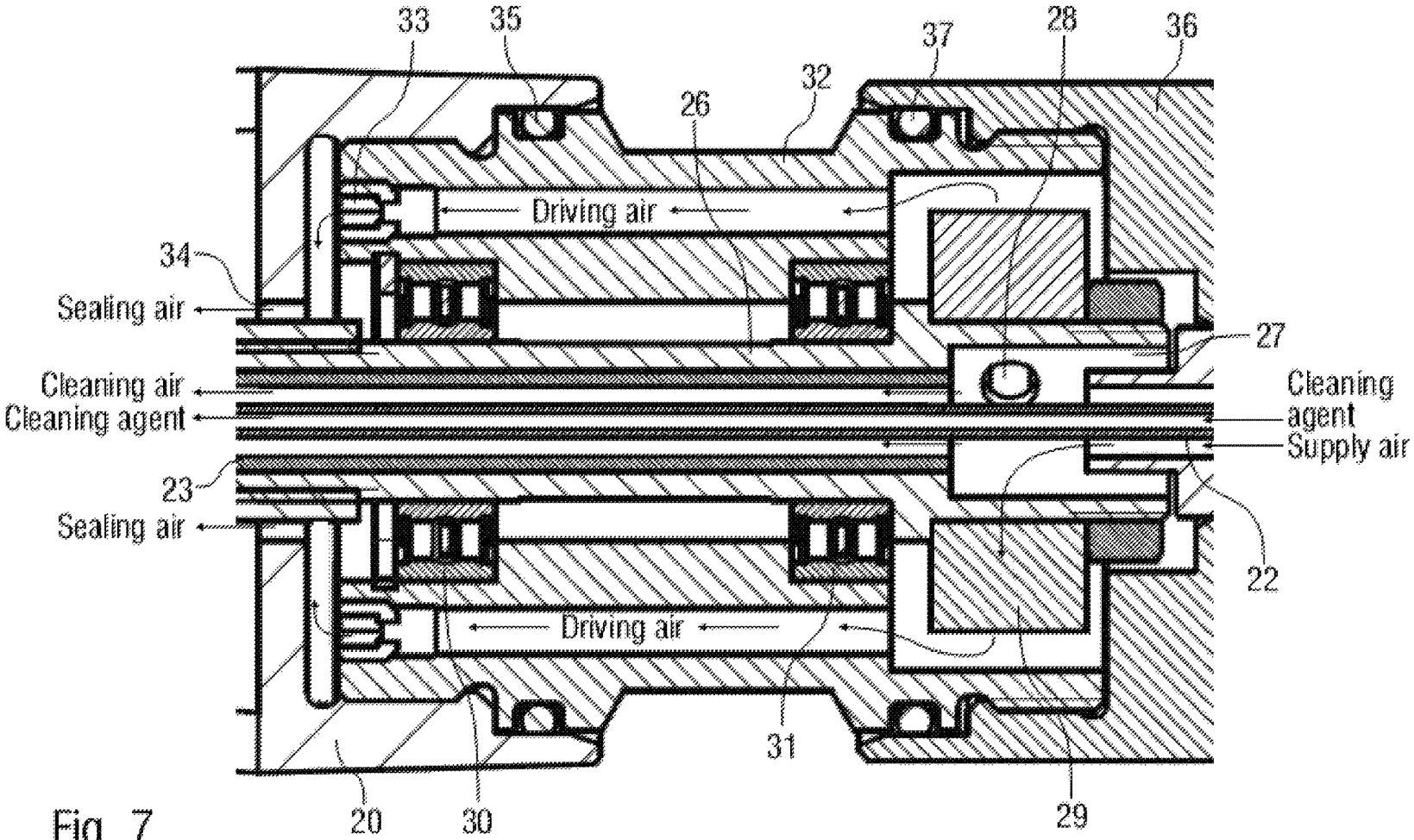
Figure 8:
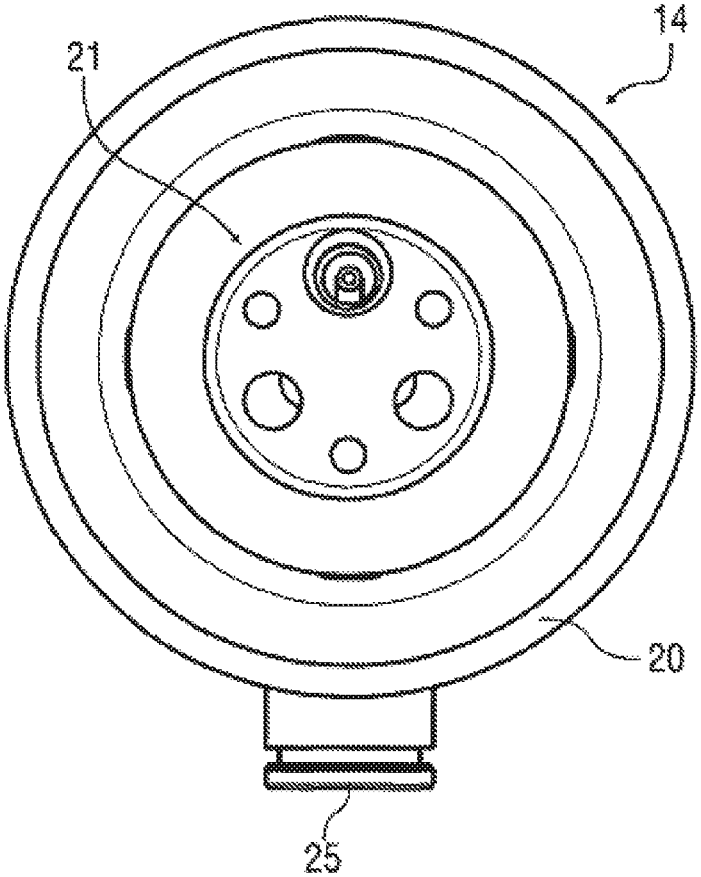
Figure 9:
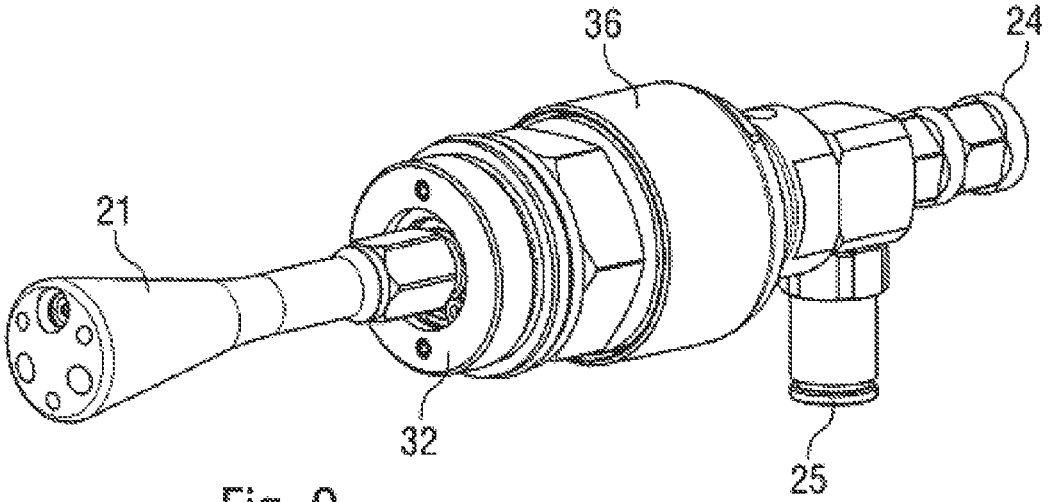

The figures show:

FIG. 1 is a schematic side view of a cleaning device according to the disclosure with a wet cleaning station and a dry cleaning station, FIG. 2 is a perspective view of the wet cleaning station from FIG. 1, FIG. 3 is a plan view of the wet cleaning station from FIG. 2, FIG. 4 is a cross-sectional view through the wet cleaning station shown in FIGS. 2 and 3 along section line A-A in FIG. 3, FIG. 5 is a perspective view of one of the cleaning nozzles of the wet cleaning station from FIGS. 2 to 4, FIG. 6 is view of a longitudinal section of the cleaning nozzle shown in FIG. 6, FIG. 7 is an enlarged detailed view of FIG. 6, FIG. 8 is a front view of the cleaning nozzle shown in FIGS. 5 to 7, and FIG. 9 is the cleaning nozzle shown in FIGS. 5 to 7 with funnel removed.

DESCRIPTION

The drawings show an exemplary embodiment of a cleaning device according to the present disclosure. With particular reference to FIG. 1, a cleaning device for cleaning a rotary atomizer 1 with a bell cup 2 according to the present disclosure is illustrated, wherein the cleaning device comprises a dry cleaning station 3 and a wet cleaning station 4.

With additional reference to FIG. 2, for cleaning, the rotary atomizer 1 is introduced along an introduction axis 5 through an introduction aperture 6 into a housing 7 of the wet cleaning station 4.

The dry cleaning station 3 is located outside the housing 7 of the wet cleaning station 4, i.e. above the wet cleaning station 4. The dry cleaning station 3 therefore cleans a rear section of the rotary atomizer 1, while the wet cleaning station 4 cleans a front section of the rotary atomizer 1 with the bell cup 2.

For cleaning of the rotary atomizer 1, the dry cleaning station 3 has an annular cleaning brush 8, which can be moved by a brush drive 9, which is shown schematically. The brush drive 9 can either rotate the annular cleaning brush 8 around the introduction axis 5, so that the cleaning brush 8 cleans the outside of the rotary atomizer 1, or the brush drive 9 can also move the cleaning brush 8 along the introduction direction 5 so that the cleaning brush 8 may virtually brush over the entire outer surface of the rotary atomizer 1.

At the end of a cleaning process, the rotary atomizer carried by a multi-axial painting robot can be extracted from the housing 7 of the wet cleaning station 4 and can then perform a tumbling motion to blow down the annular cleaning brush 8 with its shaping air, thereby cleaning it.

With additional reference to FIGS. 3-4, on the upper side of the pot-shaped housing 7, the wet cleaning station 4 has a two-part lid with a lower lid section 10 and an upper lid section 11, the two lid sections 10, 11 being fastened to each other, for example with a screw connection. The lower lid section 10 is connected to the housing 7 by three clamp fasteners 12. The clamp fasteners 12 facilitate rapid opening of the wet cleaning station 4, e.g. for maintenance purposes.

In the upper lid section 11 of the wet cleaning station 4 there is a nozzle ring 13 of blow air nozzles, which dispense blow air radially inwards so that they are able to blow the atomizer dry.

The wet cleaning station 4 has three cleaning nozzles 14, distributed at equal distances around the circumference. Each of the individual cleaning nozzles 14 dispenses a mixture of compressed air and cleaning agent along an emission direction 15 onto the outside of the rotary atomizer 1, the emission direction 15 being inclined at an angle $\alpha \approx 60°$ to the introduction direction 5.

Here the individual cleaning nozzles 14 are mounted in the wall of the housing 7 of the wet cleaning station 4 in a vibration-damped manner. The individual cleaning nozzles 14 project through a hole in the wall of the housing 7 and are fixed by an angle bracket 16. One arm of the angle bracket 16 inserts into a groove 17 of the cleaning nozzle 14, thereby fixing it in a form-fitting manner. The other arm of the angle bracket 16 rests on an elastic damping element 18 (grommet) and is fixed with two captive screws 19. The damping element 18 between the angle bracket 16 and the housing 7 of the wet cleaning station 4 thus provides vibration decoupling, so that the vibrations emanating from the cleaning nozzles 14 are only transferred to the housing 7 of the wet cleaning station 4 to a limited extent. This form of attachment of the individual cleaning nozzles 14 also allows the cleaning nozzles to be changed quickly and easily.

The structure and functional principles of the individual cleaning nozzles 14 can be seen in particular from FIGS. 4 to 9 and are further described below.

First, the individual cleaning nozzles 14 each have an external, fixed funnel 20, which widens out in a funnel shape towards its free end.

In the funnel 20 is arranged a cleaning trunk 21 that rotates in operation, said cleaning trunk 21 dispensing a mixture of compressed air and cleaning agent (e.g. solvent) in operation in order to clean the outside of the rotary atomizer 1.

A longitudinal bore runs along the inside of the cleaning trunk 21, an inner hose 22 and an outer hose 23 running inside said longitudinal bore. The inner hose 22 serves to supply a cleaning agent (e.g. solvent) that is fed in through a cleaning agent connection 24. The annular gap between the inner hose 22 and the outer hose 23 transports the cleaning air that is provided via a supply air connection 25.

The rotatable cleaning trunk 21 is screwed to a driveshaft 26, which is hollow and accommodates the inner hose 22 and the outer hose 23.

A slide bearing 27 is arranged at the upstream end in the driveshaft 26, wherein the cleaning air flows axially through the slide bearing 27 and can flow through radial holes 28 in the wall of the driveshaft out into a turbine wheel 29. The supply air fed in via the supply air connection 25 is therefore divided into cleaning air and driving air. The cleaning air flows forwards through the annular gap between the inner hose 22 and the outer hose 23 and is dispensed at the free end of the cleaning trunk 21. On the other hand, the driving air flows out through the radial holes 28 into the turbine wheel 29, thereby driving said turbine wheel. The driveshaft 26 is rotatably borne by two roller bearings 30, 31 in a housing section 32.

The driving air emerging at the turbine wheel 29 then flows forwards past the outside of the roller bearings 30, 31 through holes in hollow grub screws 33 with holes and ultimately exits forwards through sealing air nozzles 34 (cf. FIG. 7). The sealing air nozzles 34 therefore deliver a curtain of sealing air into the annular gap between the static funnel 20 and the rotating cleaning trunk 21. This minimizes contamination of the roller bearings 30, 31.

The housing section 32 is inserted into the proximal end of the funnel 20 and sealed off from the funnel 20 by a sealing ring 35. The sealing ring 35 also prevents the funnel 20 from loosening due to vibration.

At its proximal end, the housing section 32 is inserted into a further housing section 36, the housing section 32 being sealed off from the housing section 36 by an additional sealing ring 37.

Finally, the cleaning nozzle 14 also has a connecting piece 38, that can be clamped in the housing section 36 by a clamping screw 39, the connecting piece 38 comprising the cleaning agent connection 24 and the supply air connection 25.

With particular reference to FIG. 6, the inner hose 22 and the outer hose 23 open into a nozzle aperture at the free end of the cleaning trunk 21, said nozzle aperture dispensing the mixture of cleaning agent and compressed air in a particular emission direction 40. Here the cleaning trunk 21 rotates around a rotational axis 41, the emission direction 40 being inclined at an angle $\beta \approx 10°$ to the rotational axis 41. As a result of the inclination $\beta$, the emission direction 40 constantly changes due to rotation of the cleaning trunk 21 in operation and hence covers a greater area.

With continued reference to FIG. 6, the cleaning trunk 21 widens out towards its free end with a conical angle $\gamma \approx 20°$. Thereby, the mass distribution of the cleaning trunk 21 may be as rotationally symmetrical as possible, so that the minimum amount of vibration occurs, despite rotation of the cleaning trunk 21. The additional mass in the cleaning trunk 21, on the side opposite the outlet aperture of the inner hose 22 and of the outer hose 23, therefore serves to prevent any imbalance of the cleaning trunk 21.

The disclosure is not limited to the exemplary embodiments described herein. Rather, there are a large number of possible variants and modifications that similarly make use of the principles of the disclosure.

The invention claimed is:

1. A cleaning device for an atomizer, comprising:

a wet cleaning station with a housing and at least one cleaning nozzle, the at least one cleaning nozzle having a cleaning trunk rotatable relative to the housing and a nozzle aperture within the housing, the at least one cleaning nozzle being configured to dispense a cleaning fluid from the cleaning trunk at the nozzle aperture, wherein the housing is configured with an introduction aperture and to receive the atomizer therewithin through the introduction aperture and along an introduction axis, the at least one cleaning nozzle being configured to dispense the cleaning fluid on the atomizer disposed within the housing, and wherein the cleaning trunk includes at least one counterweight, the at least one counterweight configured to balance the cleaning trunk about a rotational axis of the cleaning trunk.

2. The cleaning device according to claim 1, wherein the cleaning trunk has a mass distribution and an external contour that is substantially rotationally symmetrical to a rotational axis of the cleaning trunk.

3. The cleaning device according to claim 1, further comprising a speed controller coupled to the cleaning trunk, the speed controller being a centrifugal governor configured to dissipate a part of driving air intended for driving a turbine wheel for the cleaning trunk as a function of the rotational speed of the cleaning trunk.

4. The cleaning device according to claim 3, wherein the centrifugal governor has a collar, which, on an outside surface thereof, abuts a driveshaft through which the driving air passes and, with increasing of the rotational speed, uncovers radial holes in a wall of the driveshaft, the radial holes configured to dissipate part of the driving air.

5. The cleaning device according to claim 1, wherein an outer hose and an inner hose run coaxially within a longitudinal bore of the cleaning trunk, the inner hose being configured to fluidly couple a cleaning agent feed line to the nozzle aperture, an annular gap between the outer hose and the inner hose is configured to fluidly couple an air supply line and the nozzle aperture downstream at the free end of the cleaning trunk, the inner hose being rotatably fixed relative to the outer hose.

6. The cleaning device according to claim 5, wherein the nozzle aperture is inclined at an angle to the rotational axis of the cleaning trunk.

7. The cleaning device according to claim 1, further comprising a plurality of cleaning nozzles, the cleaning nozzles being equally radially distributed about the introduction axis.

8. The cleaning device according to claim 7, wherein each of the plurality of cleaning nozzles is radially offset relative to the cleaning nozzles in adjacent planes of the plurality of planes.

9. The cleaning device according to claim 1, further comprising an inner tube disposed in the housing and oriented coaxially to the introduction axis, the inner tube configured to receive a bell cup of the atomizer.

10. The cleaning device according to claim 1, wherein the at least one cleaning nozzle is oriented to dispense cleaning fluid along a direction with an inclination with respect to the introduction axis between 20° and 85°.

11. The cleaning device according to claim 1, further comprising a nozzle mount coupled to the wet cleaning station, the nozzle mount configured to receive the at least one cleaning nozzle, the nozzle mount including vibration-damping material.

12. The cleaning device according to claim 1, wherein the cleaning trunk has a circumferentially oriented outlet aperture configured to provide a rotation driving force from a thrust of dispensing cleaning fluid, the cleaning trunk including at least one vane positioned to resist a flow of the dispensing cleaning fluid.

13. The cleaning device according to claim 1, wherein the at least one cleaning nozzle has at least one rotatable turbine wheel configured to pneumatically drive the cleaning trunk.

14. The cleaning device according to claim 13, wherein a driving air flows outwardly onto the turbine wheel, the turbine wheel has a plurality of inner apertures on the inside to receive the driving air into the turbine wheel, the apertures in the turbine wheel each open into a turbine chamber, the turbine chambers each have a circumferentially oriented outlet aperture, and, after flowing through the turbine wheel, the driving air is dispersed through sealing air nozzles outside of the cleaning trunk.

15. The cleaning device according to claim 1, further comprising a dry cleaning station outside of the housing of the wet cleaning station, the dry cleaning station including a cleaning brush, the cleaning brush being annular and configured to encircle the atomizer during cleaning.

16. The cleaning device according to claim 15, wherein the wet cleaning station is arranged along the introduction direction downstream of the dry cleaning station, the wet cleaning station being configured to clean a front section of the atomizer while the dry cleaning station cleans a rear section of the atomizer.

17. A cleaning device for an atomizer, comprising:

a wet cleaning station with a housing and at least one cleaning nozzle, the at least one cleaning nozzle having a cleaning trunk rotatable relative to the housing and a nozzle aperture within the housing, the at least one cleaning nozzle being configured to dispense a cleaning fluid from the cleaning trunk at the nozzle aperture, a speed controller coupled to the cleaning trunk, the speed controller being a centrifugal governor configured to dissipate a part of driving air intended for driving a turbine wheel for the cleaning trunk as a function of the rotational speed of the cleaning trunk, wherein the housing is configured with an introduction aperture and to receive the atomizer therewithin through the introduction aperture and along an introduction axis, the at least one cleaning nozzle being configured to dispense the cleaning fluid on the atomizer disposed within the housing.

18. The cleaning device according to claim 17, wherein the centrifugal governor has a collar, which, on an outside surface thereof, abuts a driveshaft through.

19. The cleaning device according to claim 18, wherein the at least one cleaning nozzle has at least one rotatable turbine wheel configured to pneumatically drive the cleaning trunk.

20. The cleaning device according to claim 19, wherein a driving air flows outwardly onto the turbine wheel, the turbine wheel has a plurality of inner apertures on the inside to receive the driving air into the turbine wheel, the apertures in the turbine wheel each open into a turbine chamber, the turbine chambers each have a circumferentially oriented outlet aperture, and, after flowing through the turbine wheel, the driving air is dispersed through sealing air nozzles outside of the cleaning trunk.

* * * * *